US007063418B2

(12) United States Patent
Sen

(10) Patent No.: US 7,063,418 B2
(45) Date of Patent: Jun. 20, 2006

(54) USE OF MONOMERIC AND OLIGOMERIC ADDITIVES TO STABILIZE DYES ON POROUS INK JET MEDIAS

(75) Inventor: Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/055,255

(22) Filed: Feb. 9, 2005

(65) Prior Publication Data

US 2005/0191440 A1 Sep. 1, 2005

Related U.S. Application Data

(62) Division of application No. 10/174,439, filed on Jun. 18, 2002, now Pat. No. 6,869,648.

(51) Int. Cl.
*B41J 2/01* (2006.01)

(52) U.S. Cl. ..... 347/105; 347/101

(58) Field of Classification Search ..... 347/105, 347/101, 100; 428/195, 32.1, 32.3
See application file for complete search history.

(56) References Cited

U.S. PATENT DOCUMENTS

| | | | |
|---|---|---|---|
| 3,794,484 | A | 2/1974 | Lofquist et al. |
| 3,988,292 | A | 10/1976 | Moriga et al. |
| 4,680,235 | A | 7/1987 | Murakami et al. |
| 4,737,155 | A | 4/1988 | Rollick et al. |
| 5,190,710 | A | 3/1993 | Kletecka |
| 5,393,812 | A | 2/1995 | Haley et al. |
| 5,459,222 | A | 10/1995 | Rodgers et al. |
| 5,500,467 | A | 3/1996 | Mahood |
| 5,596,033 | A | 1/1997 | Horsey et al. |
| 5,629,080 | A | 5/1997 | Gupta et al. |
| 5,670,249 | A | 9/1997 | Tanuma |
| 5,874,493 | A | 2/1999 | Webster |
| 6,904,738 | B1 | 5/1999 | Purcell |
| 6,001,466 | A | 12/1999 | Noguchi et al. |
| 6,056,812 | A | 5/2000 | Lin et al. |
| 6,100,208 | A | 8/2000 | Brown et al. |
| 6,168,655 | B1 | 1/2001 | Nohr et al. |

(Continued)

FOREIGN PATENT DOCUMENTS

| | | |
|---|---|---|
| EP | 1180436 | 2/2002 |

(Continued)

OTHER PUBLICATIONS

Baudin, Gerard, et al., Inkjet Printing: Effect of Paper Properties on Print Quality, NIP 17: Internat'l. Conf. on Digital Printing Technologies, pp. 120-124.

(Continued)

*Primary Examiner*—Manish S. Shah

(57) ABSTRACT

The present invention relates to a print medium with improved resistance to airfade. The print medium is coated with a high molecular weight additive having low volatility. The high molecular weight additive is a monomeric or oligomeric compound that has a molecular weight of greater than approximately 1000. The high molecular weight additive is a hindered amine light stabilizer or a fixative. The present invention also relates to a method of producing a print medium with improved airfastness. The method comprises coating a print medium with a high molecular weight additive having low volatility. An image is then printed on the coated print medium and subjected to at least one atmospheric gas. The airfastness of the printed image is measured and compared to the airfastness of an image printed on an uncoated print medium.

8 Claims, 4 Drawing Sheets

U.S. PATENT DOCUMENTS

| | | | |
|---|---|---|---|
| 6,171,751 | B1 | 1/2001 | Mourey et al. |
| 6,231,654 | B1 | 5/2001 | Elwakil |
| 6,235,095 | B1 | 5/2001 | Nohr et al. |
| 6,297,296 | B1 | 10/2001 | Wexler |
| 6,337,402 | B1 | 1/2002 | Wood et al. |
| 6,391,428 | B1 | 5/2002 | Ueno et al. |

FOREIGN PATENT DOCUMENTS

| | | |
|---|---|---|
| EP | 1205312 | 5/2002 |
| WO | WO 99/03685 | 1/1999 |

OTHER PUBLICATIONS

Brugger, P.A., et al., Nanoporous Photorealistic Materials for InkJet, NIP 17: Internat'l. Conf. on Digital Printing Technologies, pp. 411-413.

Darwin, David C., et al., The influence of Silica Gel Pigment Levels in Coated Ink Jet Papers, NIP 17: Internat'l. Conf. on Digital Printing Technologies, pp. 116-119.

Graczyk, Tom, et al., Gloss of Ink Jet Media at High Ink Loads, NIP17: Internat'l. Conf. on Digital Printing Technologies, pp. 112-115.

Hofmann, Rita, Imaging Permanence: Professional Photography, NIP17: Internat'l Conf. on Digital Printing Technologies, pp. 159-161.

Hogberg, Olie, et al., Humidity Effects on Plain Paper in Inkjet Printing, NIP17: Internat'l. Conf. on Digital Printing Technologies, pp. 874-877.

Morrison, Ian, E Ink Displays, NIP17: Internat'l. Conf. on Digital Printing Technologies, pp. 623-625.

Mukherjee, Anindya et al., Hyperbranched Polyesteramides for Imaging Applications, NIP17: Internat'l. Conf. on Digital Printing Technologies, pp. 382-384.

Niemoller, Axel, et al., Durability of Ink Jet Transfer Prints Based on Fusible Coatings, NIP17: Internat'l. Conf. on Digital Printing Technologies, pp. 250-253.

Oakland, Michelle, et al., Arrhenius Testing Under Controlled Atmospheres: Measurement of Dark Keeping Properties of Inkjet Photographic Prints, NIP17: Internat'l. Conf. on Digital Printing Technologies, pp. 167-170.

Oakland, Michelle, et al., Ozone Concentration Effects on the Dark Fade of Inkjet Photographic Prints, NIP17: Internat'l Conf. on Digital Printing Technologies, pp. 175-178.

Onishi, Hiroyuki, et al., Image Permanence of Ink Jet Photographic Prints, NIP17: Internat'l. Conf. on Digital Printing Technologies, pp. 192-196.

Steiger, Rolf, et al., Light Stability and Gas Fading on Nanoporous Ink-Jet Materials, NIP17: Internat'l. Conf. on Digital Printing Technologies, pp. 222-225.

Chinook Ink on Nanoporous Media

Chinook Ink on Nanoporous Media

Kaos Ink on Nanoporous Media

Kaos Ink on Nanoporous Media

USE OF MONOMERIC AND OLIGOMERIC ADDITIVES TO STABILIZE DYES ON POROUS INK JET MEDIAS

This is a division of application Ser. No. 10/174,439 filed Jun. 18, 2002 now U.S. Pat. No. 6,869,648.

FIELD OF THE INVENTION

The present invention relates to a print medium for use in ink-jet printing and, more specifically, to incorporating an additive into the print medium to produce a print medium with improved permanence.

BACKGROUND OF THE INVENTION

The use of inkjet printing systems in offices and homes has grown dramatically in recent years. The growth can be attributed to drastic reductions in cost of inkjet printers and substantial improvements in print resolution and overall print quality. While the print quality has drastically improved, research and development efforts continue toward improving the permanence of inkjet images because this property still falls short of the permanence produced by other printing and photographic techniques. A continued demand in inkjet printing has resulted in the need to produce images of high quality, high permanence, and high durability, while maintaining a reasonable cost.

In inkjet printing, the inkjet image is formed on a print medium when a precise pattern of dots is ejected from a drop-generating device known as a print-head. The typical inkjet printhead has an array of precisely formed nozzles located on a nozzle plate and attached to an inkjet printhead array. The nozzles are typically 30 to 40 μm in diameter. The inkjet printhead array incorporates an array of firing chambers that receive liquid ink, which comprises colorants, pigments, and/or dyes dissolved or dispersed in a liquid vehicle, through fluid communication with one or more ink reservoirs. Each chamber has a thin-film resistor, known as a firing resistor, located opposite the nozzle so ink can collect between the firing resistor and the nozzle. The printhead is held and protected by an outer packaging referred to as a print cartridge or an inkjet pen.

Upon energizing of a particular firing resistor, a droplet of ink is expelled through the nozzle toward the print medium to produce the image. Printed images that have good print quality are a function of both the ink composition and the print medium upon which the image is printed. Ideally, the ink composition would have a high degree of permanence, a fast drying time, a long shelf-life, and would provide the desired chroma with the desired fastness or permanence properties. Ideally, the print medium would have sufficient ink-absorbency, a high degree of permanence, and high dryability.

Various factors affect the permanence of the printed image, such as exposure to humidity, temperature, water, plasticizer, light, or atmospheric gases. Atmospheric gases that affect the permanence of the printed image include, but are not limited to, $O_2$, $O_3$, $SO_2$, and oxides of nitrogen. The oxides of nitrogen include, but are not limited to, nitrous oxide, nitric oxide, nitrogen sesquioxide, nitrogen dioxide, dinitrogen tetroxide, dinitrogen pentoxide, and mixtures thereof. These atmospheric gases, which include oxidizing and reducing gases, fade or degrade the colors in printed images. The atmospheric gases are present in air and, therefore, printed images fade upon exposure to air.

The airfastness of the printed image is a function of both the ink composition and the print medium. The ability of the printed image to resist fading upon exposure to atmospheric gases is referred to as airfastness or resistance to airfade. The printed image is airfast if the printed image does not exhibit shifts in color or a decrease in color density upon exposure to atmospheric gases. It is known in the art that cyan colored inks are less airfast than magenta colored inks, which are less airfast than yellow colored inks. In addition, black inks are also known to fade upon exposure to atmospheric gases.

Colorants in the ink fade when exposed to atmospheric gases due to photodegradation mechanisms, which include oxidation or reduction of the colorants, electron ejection from the colorant, reaction with ground-state or excited singlet state oxygen, and electron or hydrogen atom abstraction to form radical intermediates. More specifically, the atmospheric gases generate free radicals that degrade the ink composition and/or the print media and generate more free radicals, which further accelerates the degradation process.

Airfade or gasfade in porous print media has only recently been identified as a significant problem and, therefore, few solutions to this problem have been proposed. One proposed solution is to add metal oxides to the print media, as discussed in Rolf Steiger, "Light Stability and Gas Fading on Nanoporous Ink-Jet Materials," NIP17: International Conference on Digital Printing Technologies, p. 222–225. Other proposed solutions include forming a barrier layer over the printed image using lamination techniques or using low molecular weight hindered amine light stabilizers ("HALS"), antioxidants, and UV absorbers. While barrier layers are effective, their use is time consuming and cost intensive. The low molecular weight additives are also problematic because some of the additives that were used were sacrificial and, therefore, did not provide long term protection. Other additives, while being regenerative, were not effective due to their low volatility. In addition, only a few additives were tested in aqueous systems due to the limited solubility of the additives in water.

Airfade or gasfade has been a longstanding problem in the textile industry because textiles (such as clothing, carpets, etc.) are comprised of dyed fibers that are constantly exposed to atmospheric gases. On exposure to atmospheric gases, the dyed fibers fade or turn yellow. Low molecular weight additives, such as color stabilizers, have been added to the dyed fibers to improve their airfastness. These additives include antioxidants, HALS, UV absorbers, and free radical quenchers, and are typically oligomeric compounds that have lower volatility. Light stabilizers, such as HALS, react with free radicals and prevent these free radicals from generating additional free radicals.

For example, in U.S. Pat. No. 4,737,155 to Rollick et al, oxadiazine thiones and triazine thiones were added to dyes to improve their resistance to ozone. In U.S. Pat. No. 3,794,464 to Lofquist et al., polytertiary amines were added to dyed nylon fibers to improve their resistance to ozone. In U.S. Pat. No. 5,500,467 to Mahood, a phosphite and a hindered phenolic antioxidant or a HALS was added to polyolefin fibers to improve their resistance gasfade. In U.S. Pat. No. 5,596,033 to Horsey et al., a HALS was used to improve the gasfade of polypropylene fibers. In U.S. Pat. No. 3,988,292 to Moriga et al., a triazine derivative was used to improve the gasfade of polyurethanes and cellulose acetates. In U.S. Pat. No. 5,904,738 to Purcell, dyed textiles were treated with at least one polyalkylene imine to improve their resistance to gasfade.

In light of the problems associated with the airfastness of printed images, it would be advantageous to improve the airfastness of printed images using high molecular weight additives that have low volatility.

SUMMARY OF THE INVENTION

In accordance with the invention, a print medium with improved resistance to airfade is provided. The print medium comprises a coating that incorporates an additive onto the print medium. The additive comprises a high molecular weight, monomeric or oligomeric compound, such as a UV absorber, a light stabilizer, a fixative, a free radical scavenger, or an antioxidant. The additive preferably has a molecular weight over 1000.

In addition, a method of producing a print medium with improved airfade is provided. A print medium is coated with a high molecular weight additive having low volatility. An image is printed on the print medium and exposed to atmospheric gases. Then, the airfastness of the printed image is measured and compared to the airfastness of an image printed on an uncoated print medium.

DESCRIPTION OF THE DRAWINGS

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

Figure 1:
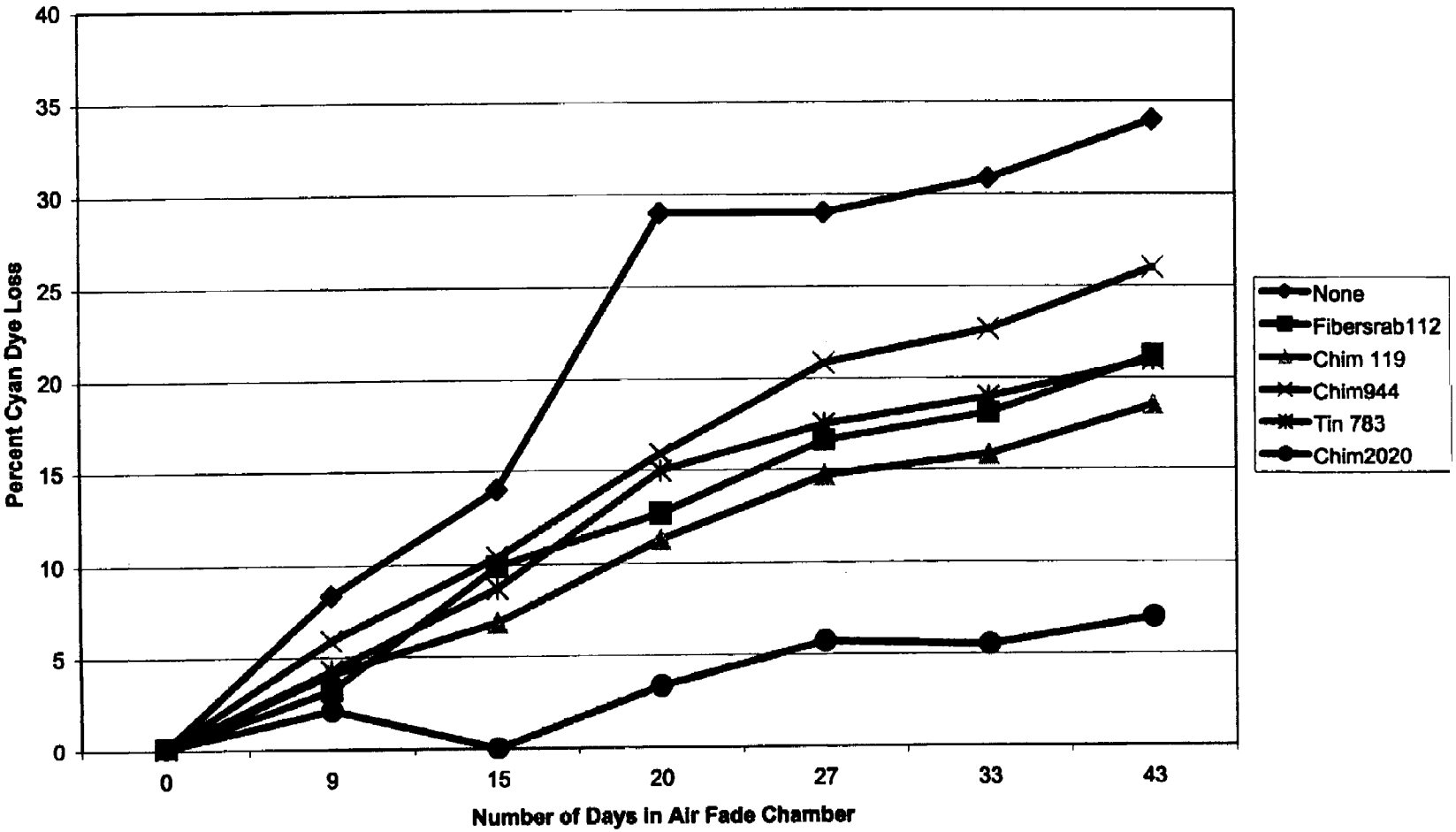
FIGS. 1 and 2 show the percentage of cyan dye loss fade for a Cu-phalocyanine based dye blend (Test Ink 1) printed on coated and uncoated nanoporous media.

An additive is used to improve the airfastness of an image printed on print medium coated with the additive of the present invention. The additive may comprise a high molecular weight UV absorber, light stabilizer, free radical scavenger, antioxidant, or fixative. The term "high molecular weight" refers to an additive having a molecular weight of greater than approximately 1000. More preferably, the molecular weight is greater than 1500. This additive may be monomeric or oligomeric. More specifically, the additive may comprise a high molecular weight HALS. In addition, the additive may have low volatility. Preferably, a monomeric or oligomeric HALS having a high molecular weight and low volatility may be used.

It is also contemplated that more than one additive may be used to obtain the desired airfastness. For example, multiple HALS, antioxidants, or antiozonants may be used or a combination of at least one HALS may be used in combination with at least one antioxidant or at least one antiozonant.

A monomeric HALS that may be used in the present invention is CHIMASSORB 119, available from Ciba Specialty Chemicals (Vienna, Austria), having the chemical structure R—NH—$(CH_2)_3$—NR—$(CH_2)_2$—NR—$(CH_2)_3$—NH—R, where R is

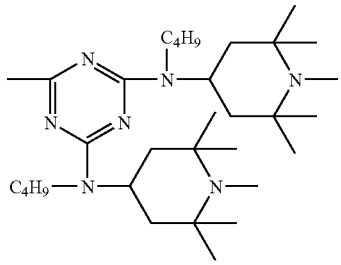

In addition, other high molecular weight monomeric HALS may be used in the present invention.

Oligomeric HALS may also be used, such as CHIMASSORB 944 or CHIMASSORB 2020, both available from Ciba Specialty Chemicals (Vienna, Austria). CHIMASSORB 944 has the following chemical structure:

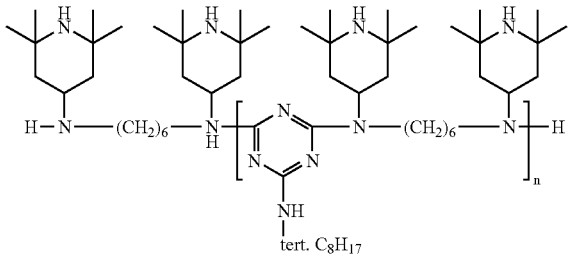

CHIMASSORB 2020 has the following chemical structure:

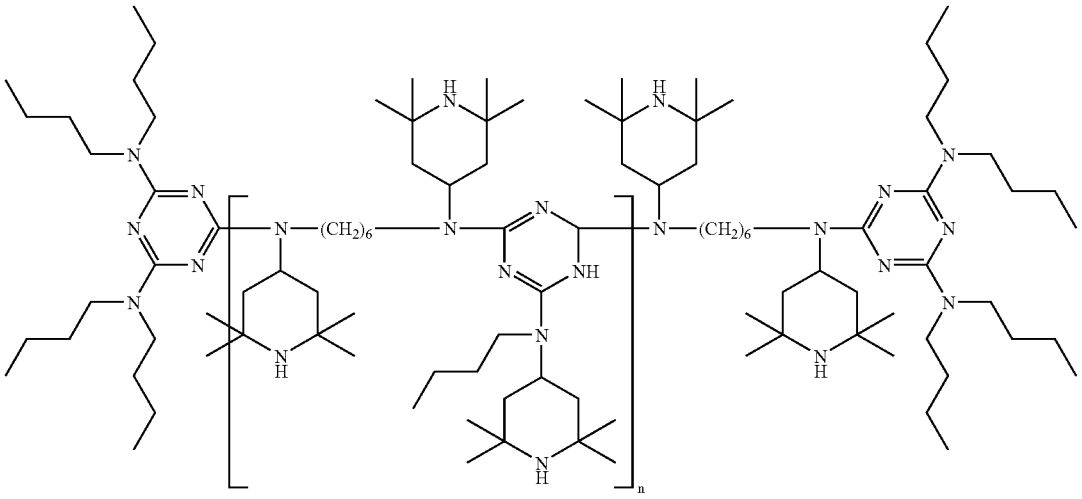

Other high molecular weight oligomeric HALS may also be used in the present invention.

Multicomponent additive systems may also be used, wherein at least one of the components is a high molecular weight additive, such as a high molecular weight HALS. The high molecular weight additive may be monomeric or oligomeric. For example, FIBERSTAB 112, available from Ciba Specialty Chemicals (Vienna, Austria), may be used to achieve the desired airfastness. FIBERSTAB 112 comprises a phosphate processing stabilizer, a lactone, and TINUVIN 622 (a high molecular weight HALS). The chemical structure of TINUVIN 622 is:

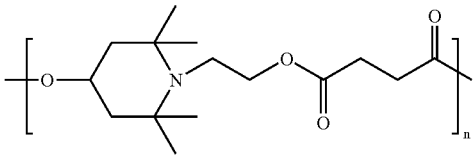

TINUVIN 783, which comprises a mixture of two oligomeric HALS, may also be used. TINUVIN 783 comprises CHIMASSORB 944 and TINUVIN 622, the chemical structures of which have been previously described. Other multicomponent additives may also be used, wherein each of the components has a high molecular weight or the combination of components has a high molecular weight.

In addition, TINUVIN 1060, which is available from Ciba Specialty Chemicals (Vienna, Austria), may be used to achieve the desired airfastness.

Fixatives may also be used to achieve the desired airfastness. For example, INTRAFIX JS and INTRAFIX JP, available from Yorkshire Chemical (Yorkshire, UK), are cationic, polymeric fixatives that may be coated on the print medium to increase the airfastness of the printed image. INTRAFIX JP is also known as a gas fade inhibitor. INTRANEX N8 150%, available from Yorkshire Chemical (Yorkshire, UK), is an anionic, phenolic condensate that also has ozone scavenging properties and may be coated on the print medium to increase the airfastness of the printed image.

The high molecular weight additive having low volatility may be incorporated into the print medium by soaking the print medium in a wash coat having the additive. The print medium may include a support layer and an ink receptive layer, as known in the art. The print medium may include a porous print medium known in the art, such as a nanoporous media. The wash coat may be formed by dissolving the additive in an appropriate solvent. The solvent may include, but is not limited to, water, methyl ethyl ketone ("MEK"), or tetrahydrofuran ("THF"). Other solvents may be used depending on the solubility of the additive. To achieve the desired airfastness, the additive may be present at 0.5–5% by weight of the wash coat. Preferably, the additive is present at 0.5–3 wt. %. Most preferably, the additive is present at 2 wt. %.

In addition, the additive may be incorporated into the print medium using a rod or bar coating technique. The rod or bar coating technique may provide higher efficiency of incorporating the additive into the print medium than other techniques because it dissolves the additive at the molecular level. Furthermore, a print medium coated by this technique may comprise a more homogenous coating than is provided by other techniques. The additive may also be incorporated into the print medium using a cosolvent, by emulsifying or dispersing the additive, or by adding the additive to wet pulp before the print medium is produced. Other means known in the art of incorporating the additive may also be used.

Depending on the technique used to impregnate the additive into the print medium and the type of print medium used, the additive may be impregnated in the ink receptive layer of the print medium or may be diffused into the support layer. The impregnated print medium may be dried by allowing the solvent to evaporate. The desired image may then be printed onto the coated, print medium using a conventional inkjet printer and inkjet inks. The inkjet inks may comprise various colorants, dyes, or pigments known in the art and may further include various vehicles, depending on the desired properties of the ink. It is also contemplated that the desired image may be printed with black ink, since black ink also exhibits airfade problems. Preferably, aqueous-based inkjet inks are used.

The printed image may then be placed in an airfade chamber and monitored for airfade using a densitometer. The airfade chamber may expose the printed image to environmental conditions of known temperature, humidity, and pressure. In the airfade chamber, the printed image may be exposed to air or may be exposed to a predetermined atmospheric gas or a combination of predetermined atmospheric gases. If a predetermined atmospheric gas or gases are used, the concentration of the atmospheric gas or gases may be controlled. The color density of the printed image may be initially measured after printing. The color density may then be monitored at predetermined intervals and compared to the initial measurement. In addition, the color density of the image printed on the coated print medium may be compared to the color density of an image printed on an uncoated print medium, which is a print medium that does not comprise an additive.

It is also contemplated that the high molecular weight, low volatility additive may be used in an ink composition to improve the airfastness of the printed image. The additive may be added to the ink composition in a percentage that does not substantially increase the viscosity of the ink because increased viscosity may affect the ink's jetting performance. It may also be necessary to add the additive in a low percentage depending on the additive's solubility in an aqueous-based ink.

The invention will now be further illustrated by, but not limited to, the following examples.

EXAMPLES

In the following examples, the effects on airfastness of coated print media were compared to uncoated print media. The coated print media exhibited improved airfade in comparison to the uncoated print media. An image was printed on both the coated and uncoated print media and each of their resistance to airfade was determined by placing the printed images in an airfade chamber. The color density of the printed images on the coated and uncoated print media was initially measured after printing. The color density was then monitored at predetermined intervals and compared to the initial measurement. The color density of the images printed on the coated print media was also compared to the color density of the images printed on the uncoated print media.

Example 1

Preparation of Coated Print Media

Wash coats were prepared by dissolving 0.5%, 1.0%, and 2.0% of each of the additives, by weight, in a solvent selected to dissolve the additive. The additives tested include CHIMASSORB 119, CHIMASSORB 944, TINUVIN 123, TINUVIN 292, TINUVIN 1060, FIBERSTAB 112, INTRAFIX JS, INTRAFIX JP, and INTRATEX N8. TINUVIN 123 and TINUVIN 292, which are both low molecular weight HALS, were tested to determine whether high molecular weight HALS provide improved airfastness. CHIMASSORB 119, CHIMASSORB 944, TINUVIN 123, TINUVIN 292, TINUVIN 1060, and FIBERSTAB 112 were dissolved in MEK. INTRAFIX JS, INTRAFIX JP, and INTRATEX N8 were solubilized in water. CHIMASSORB 2020 was solubilized in THF.

A nanoporous media paper was coated with the additive by placing the nanoporous media paper in the wash coat solution, thereby allowing the additive to impregnate the nanoporous media paper. The nanoporous media paper was also coated with the additive using a rod or bar coating technique.

After the coated papers dried, images were printed using cyan Test ink 1 and Test ink 2. Different inks were used to show that the effects of the additive were not specific to one ink system and, therefore, will work on different ink systems.

Example 2

Measurement of Fade of Cyan Dyes

The printed, coated papers were stored in an air fade chamber maintained at room conditions. The air fade chamber used a fan that directed air onto or past the surface of the coated paper. The color density of each printed, coated paper was measured 24 hours after printing to establish the initial color density. The color density of each printed, coated paper was subsequently measured at predetermined intervals and compared to the initial measurement.

The percentage of dye loss was measured at predetermined intervals after the initial reading. The percentage of dye loss was calculated by subtracting the measured color density at the predetermined interval from the initial color density, and expressing it as a percentage. The color density of the printed image on each of the coated papers was also compared to an image printed on an uncoated paper (i.e. a paper that comprised no additive).

The percentage of dye loss for the printed, coated papers comprising 2% by weight of each additive is presented in Tables 1–4. Coated papers having 0.5% and 1.0% of the additive showed similar results.

TABLE 1

Percentage Dye Loss for Cyan Test Ink 1 on nanoporous media using 2% Additive

| | 1 day | 4 days | 10 days | 15 days | 17 days |
|---|---|---|---|---|---|
| None | −1.34 | 4.54 | 9.55 | 18.19 | 21 |
| CHIMASSORB 119 | 0.52 | 2.93 | 4.74 | 8.7 | 12.6 |
| INTRAFIXJP | 0.436 | 6.15 | 9.25 | 12.8 | 14.79 |
| INTRAFIXJS | −0.66 | 0.533 | 1.419 | 3.72 | 8.67 |
| INTRATEXN8 | −0.06 | 0.21 | 0.5 | 0.76 | 5.95 |

TABLE 1-continued

Percentage Dye Loss for Cyan Test Ink 1 on nanoporous media using 2% Additive

| | 1 day | 4 days | 10 days | 15 days | 17 days |
|---|---|---|---|---|---|
| TINUVIN 123 | 0.84 | 4.45 | 5.27 | 12.17 | 16.69 |
| TINUVIN 144 | 0.57 | 4.44 | 6 | 8.41 | 15.75 |
| TINUVIN 292 | 0.96 | 9.51 | 15 | 24.3 | 26.8 |
| TINUVIN 1060 | 0.56 | 5.19 | 12.88 | 15 | 17.7 |

TABLE 2

Percentage Dye Loss for Cyan Test Ink 1 on nanoporous media using 2% Additive

| | 0 | 9 days | 15 days | 20 days | 27 days | 33 days | 43 days |
|---|---|---|---|---|---|---|---|
| None | 0.1 | 8.35 | 14 | 29 | 29 | 30.85 | 34 |
| FIBERSTAB 112 | 0.1 | 3.22 | 9.9 | 12.7 | 16.6 | 18.095 | 21.19 |
| CHIMASSORB 119 | 0.1 | 4.1 | 6.85 | 11.3 | 14.68 | 15.8 | 18.5 |
| CHIMASSORB 944 | 0.1 | 5.9 | 10.38 | 15.9 | 20.83 | 22.66 | 26 |
| TINUVIN 783 | 0.1 | 4.28 | 8.72 | 14.97 | 17.48 | 18.96 | 21 |
| CHIMASSORB 2020 | 0.1 | 2.15 | 2.2.7 | 3.36 | 5.72 | 5.51 | 7 |

TABLE 3

Percentage Dye Loss for Cyan Test Ink 2 on nanoporous media using 2% Additive

| | 1 day | 4 days | 10 days | 15 days | 17 days |
|---|---|---|---|---|---|
| None | 1.44 | 8.26 | 12 | 15 | 23 |
| CHIMASSORB 119 | 0.283 | 1.4 | 2 | 3.78 | 5.29 |
| INTRAFIXJP | −0.869 | 1.055 | 1.5 | 1.8 | 1.9 |
| INTRAFIXJS | 0.244 | 0.248 | 0.32 | 0.399 | 3.28 |
| TINUVIN 123 | 1.133 | 7.15 | 11.23 | 18.41 | 22 |
| TINUVIN 292 | 1.759 | 11.14 | 14.75 | 24.6 | 28 |
| TINUVIN 1060 | 0.857 | 6.66 | 9.81 | 17.06 | 20 |

TABLE 4

Percentage Dye Loss for Cyan Test Ink 2 on nanoporous media using 2% Additive

| | 0 | 9 days | 15 days | 20 days | 27 days | 33 days | 43 days |
|---|---|---|---|---|---|---|---|
| None | 0.1 | 8.9 | 15 | 26 | 29 | 32 | 38 |
| FIBERSTAB 112 | 0.1 | 5.8 | 5.3 | 9.5 | 11.37 | 11.69 | 13.6 |
| CHIMASSORB 119 | 0.1 | 3.4 | 8.8 | 15.5 | 17.8 | 18.93 | 22 |
| CHIMASSORB 944 | 0.1 | 6.3 | 13.6 | 23 | 24 | 26.71 | 29 |
| TINUVIN 783 | 0.1 | 10 | 8.8 | 16.26 | 15.34 | 16 | 18 |
| CHIMASSORB 2020 | 0.1 | 5.2 | 1.16 | 1.29 | 0.92 | 0.524 | 0.73 |

Figure 2:
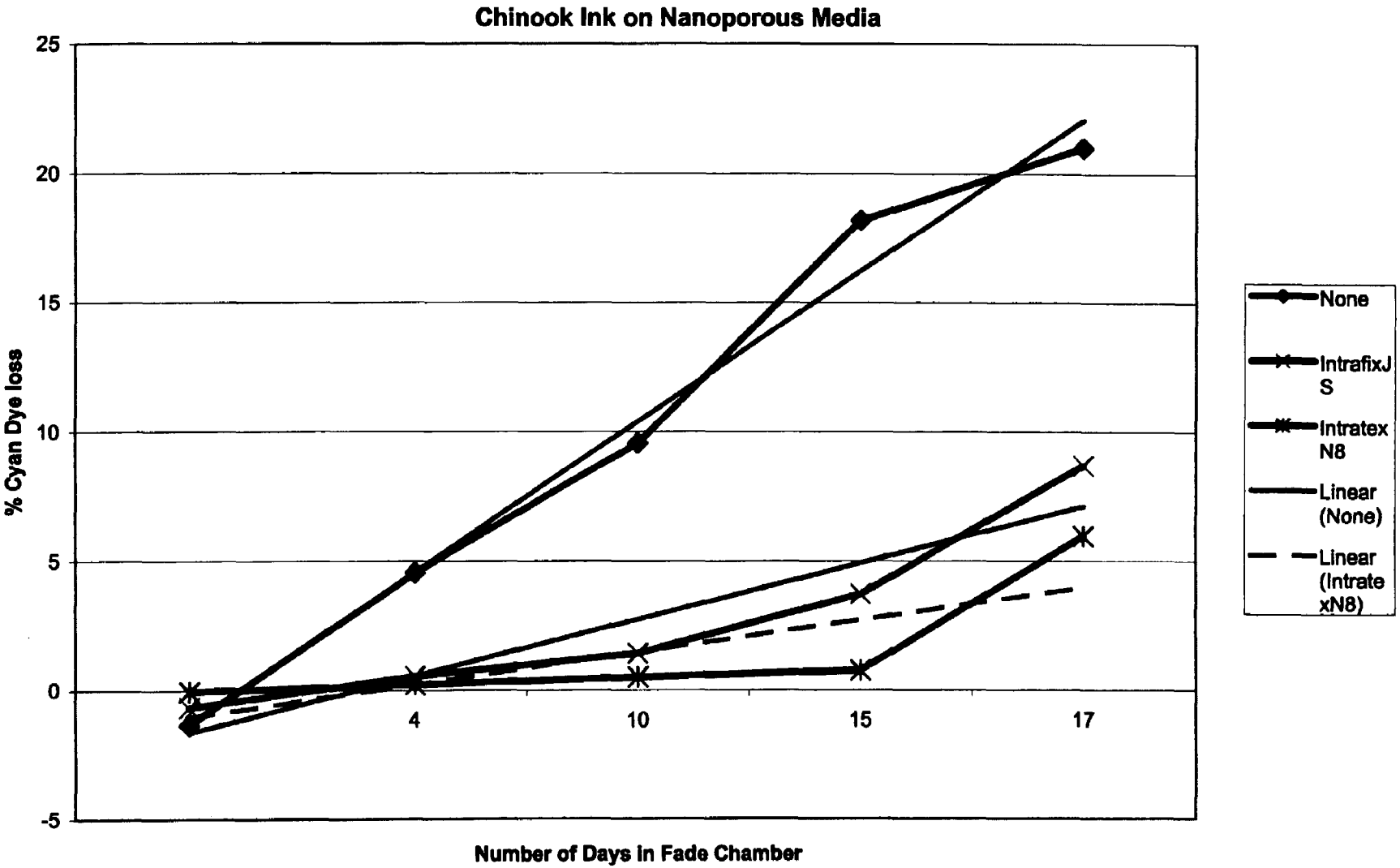
Figure 3:
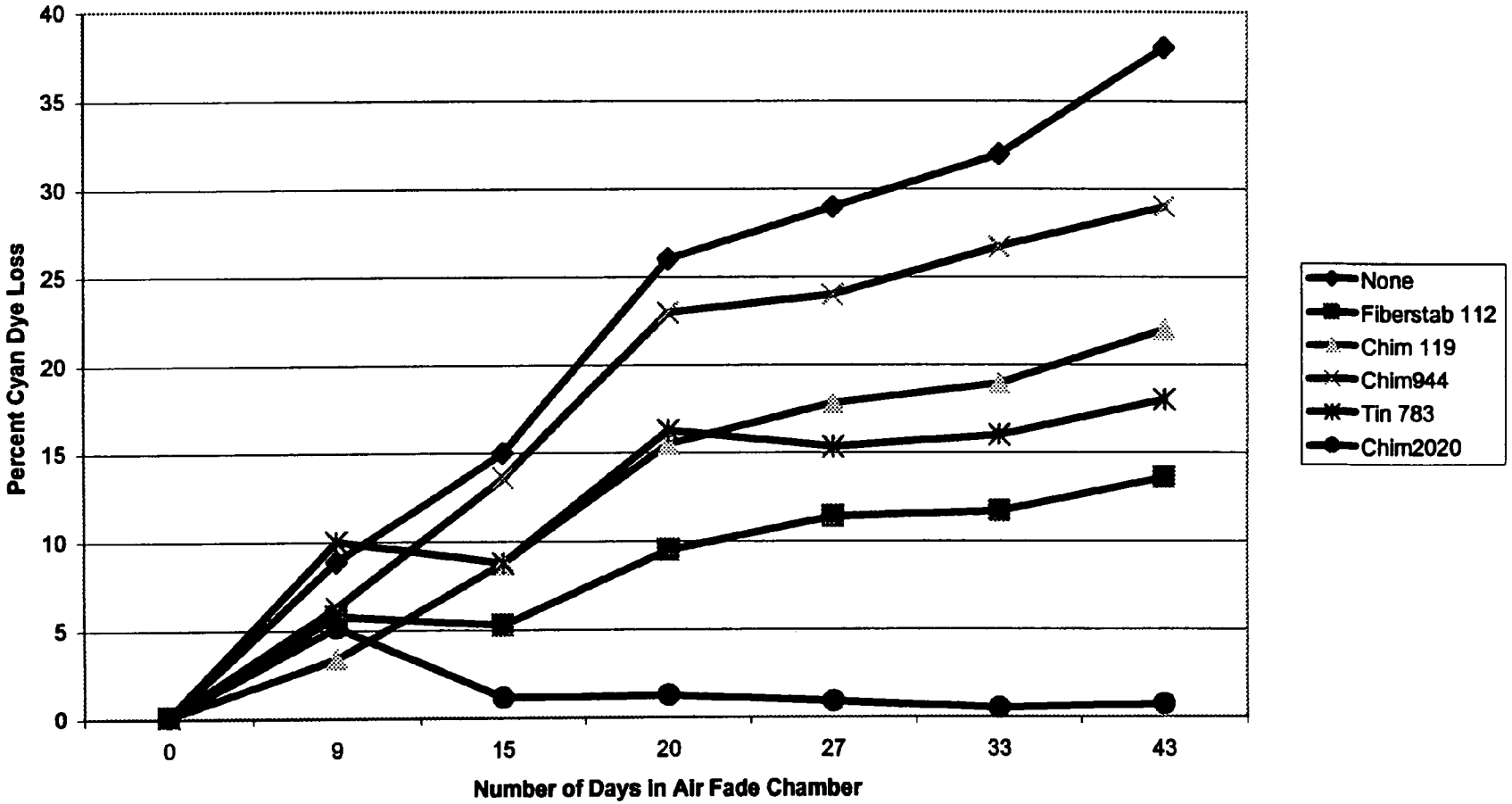
FIGS. 3 and 4 show the percentage of cyan dye loss fade for a Cu-phalocyanine based dye (Test Ink 2) printed on coated and uncoated nanoporous media.
Figure 4:
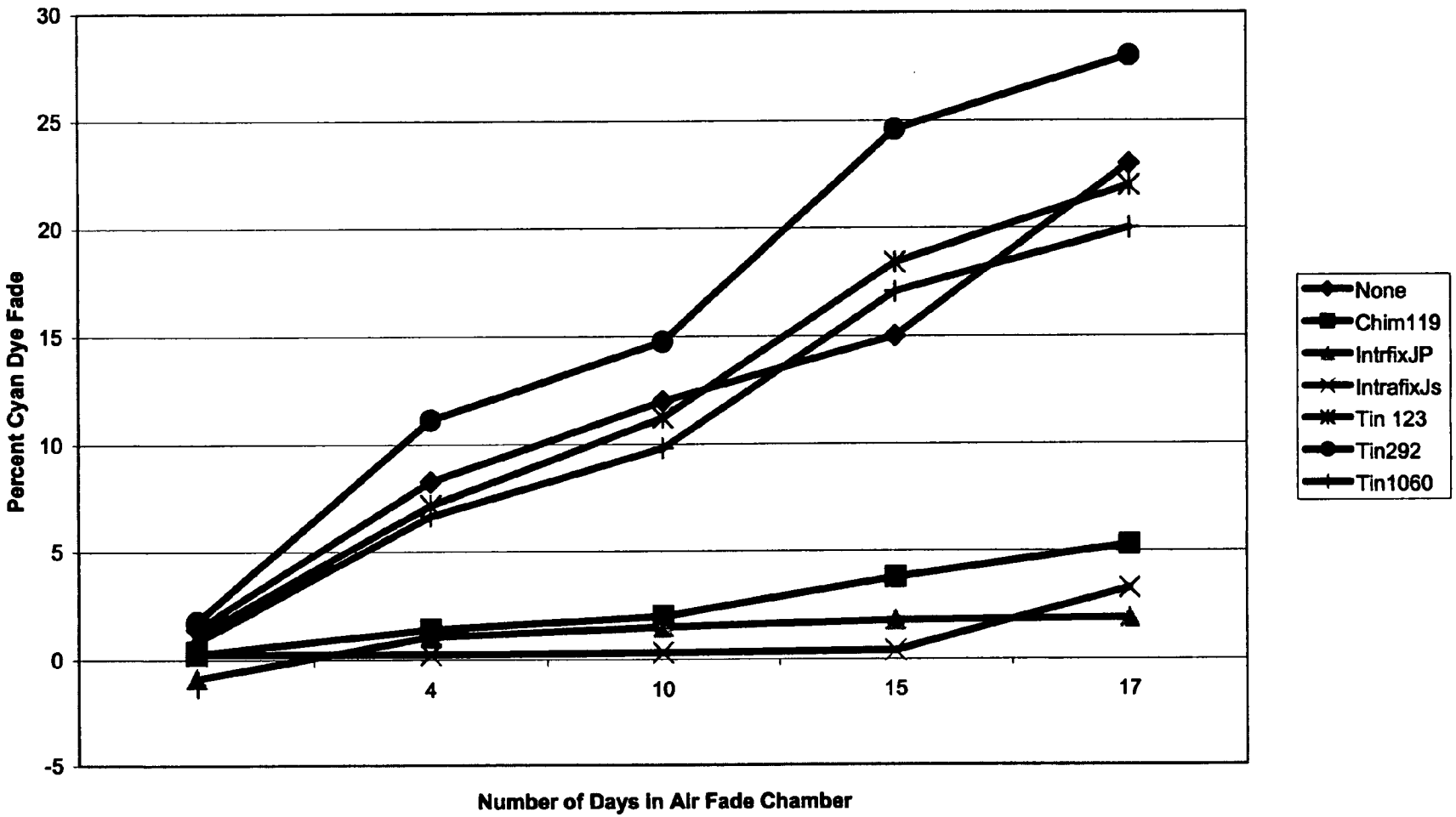

As shown in FIG. 1, the print media coated with high molecular weight additives had improved airfastness over a 43 day time period compared to the uncoated print medium. Specifically, the print media coated with CHIMASSORB 119, CHIMASSORB 944, CHIMASSORB 2020, TINUVIN 783, and FIBERSTAB 112 had improved airfastness in comparison to the uncoated print medium. CHIMASSORB 2020 had substantially improved airfastness compared to the uncoated print medium. The fixatives INTRAFIX JS, INTRAFIX JP, and INTRATEX N8 also showed improved airfastness compared to the uncoated print medium, as shown in Table 1 and FIG. 2. While the data plotted in FIGS. 1 and 2 are for cyan Test Ink 1, similar trends were also observed for cyan Test Ink 2 systems, as shown in FIGS. 3 and 4.

As shown in Tables 1 and 3, the print media coated with high molecular weight additives had improved airfastness compared to print media coated with low molecular weight additives (TINUVIN 123 and 292).

In summary, print media coated with high molecular weight additives, both monomeric and oligomeric, showed increased resistance to airfade in comparison to uncoated print media and print media coated with low molecular weight additives.

Example 3

Measurement of Fade of Magenta Dyes

Magenta dyes were also tested on print media coated with the additives described in Example 1. Images were printed using magenta dyes and the percentage of dye loss was measured as described in Example 2. Similar trends in the percentages of dye loss were observed with the magenta dyes.

The additives disclosed herein are expected to find commercial use in print media used in inkjet printers. The method of using the additives of the present invention is expected to find use in inkjet printing applications involving the printing of color inks.

Thus, there have been disclosed additives that provide improved airfastness or resistance to airfade of a printed image. It will be readily apparent to those skilled in this art that various changes and modifications may be made without departing from the spirit of the invention, and all such changes and modifications are considered to fall within the scope of this invention as defined by the appended claims.

What is claimed is:

1. A method of producing a print medium with improved airfastness, said method comprising:

coating a print medium with a high molecular weight additive selected from the group consisting of R—NH—$(CH_2)_3$—NR—$(CH_2)_2$—NR—$(CH_2)_3$—NH—R, where R is

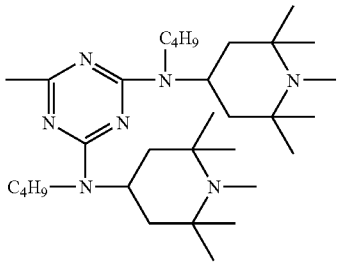

and

-continued

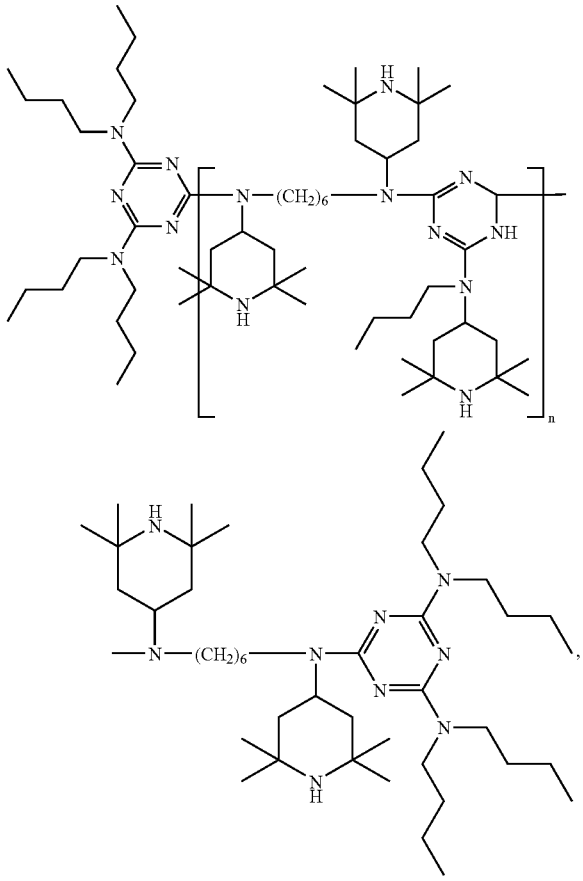

or a combination thereof, printing an image on said print medium; and subjecting the printed image to at least one atmospheric gas.

2. The method of claim 1, wherein coating a print medium with a high molecular weight additive comprises coating said print medium with a high molecular weight additive using a rod or bar coating technique.

3. The method of claim 1, wherein coating a print medium with a high molecular weight additive comprises coating said print medium with about 2.0% by weight of said high molecular weight additive.

4. The method of claim 1, wherein coating a print medium with a high molecular weight additive comprises coating said print medium with an additive having a molecular weight of greater than approximately 1000.

5. The method of claim 1, wherein coating a print medium with a high molecular weight additive comprises coating said print medium with an additive having a molecular weight of greater than approximately 1500.

6. The method of claim 1, wherein coating a print medium with a high molecular weight additive comprises coating said print medium with a monomeric or oligomeric high molecular weight additive.

7. The method of claim 1, wherein coating a print medium with a high molecular weight additive comprises coating said print medium with a fixative.

8. A method of producing a print medium with improved airfastness, said method comprising:

coating a print medium with an additive having a high extraction resistance and a molecular weight of greater than approximately 1000, said additive selected from the group consisting of R—NH—$(CH_2)_3$—NR—$(CH_2)_2$—NR—$(CH_2)_3$—NH—R, where R
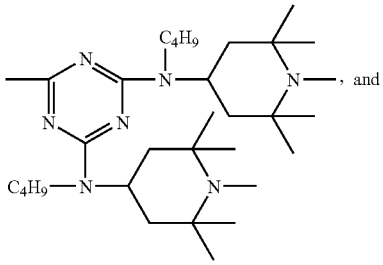
, and
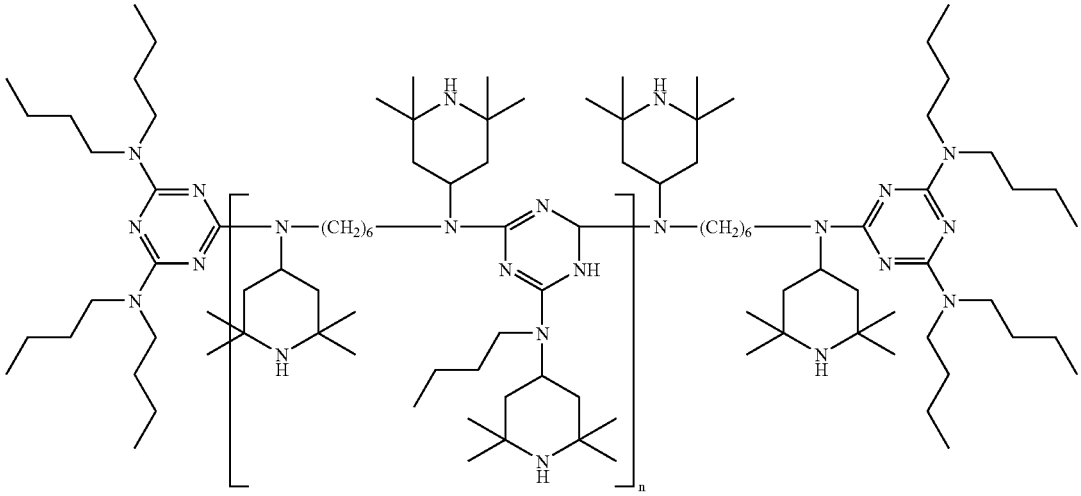
,
or a combination thereof; and
printing an image on said print medium.
* * * * *